US010252954B1

(12) United States Patent
Park et al.

(10) Patent No.: US 10,252,954 B1
(45) Date of Patent: Apr. 9, 2019

(54) MULTI-LAYERED STABLE PROPELLANT COMPOSITION

(71) Applicant: The United States of America as Represented by the Secretary of the Army, Washington, DC (US)

(72) Inventors: Dongkyun Park, Dover, NJ (US); Joseph Laquidara, Westwood, NJ (US); Viral Panchal, Parlin, NJ (US); Ryan Ordemann, Verona, NJ (US); Carlton Adam, Newton, NJ (US); Robin Crownover, Rockaway, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 16 days.

(21) Appl. No.: 15/591,159

(22) Filed: May 10, 2017

Related U.S. Application Data

(60) Provisional application No. 62/337,543, filed on May 17, 2016.

(51) Int. Cl.

| | |
|---|---|
| ***C06B 45/24*** | (2006.01) |
| ***C06B 45/12*** | (2006.01) |
| *C06B 45/00* | (2006.01) |
| *D03D 23/00* | (2006.01) |
| *D03D 43/00* | (2006.01) |

(52) U.S. Cl.
CPC ..... *C06B 45/12* (2013.01)

(58) Field of Classification Search
USPC ..... 149/2, 12, 109.4
See application file for complete search history.

(56) References Cited

U.S. PATENT DOCUMENTS

| | | | | |
|---|---|---|---|---|
| 3,166,612 | A * | 1/1965 | Sauer | C06B 21/0075 149/12 |
| 4,013,743 | A | 3/1977 | Blasche, Jr. | |
| 4,581,998 | A | 4/1986 | Horst, Jr. | |
| 4,713,127 | A * | 12/1987 | Muller | C06B 23/006 149/100 |
| 5,690,868 | A | 11/1997 | Strauss | |
| 6,042,663 | A * | 3/2000 | Evans | C06B 25/20 149/100 |
| 6,167,810 | B1 | 1/2001 | Isle | |

(Continued)

OTHER PUBLICATIONS

TNO, Experimental set-up and results of the process of co-extruded perforated gun propellants, IM/EM Symposium, Tucson, AZ, May 2009. available at http://www.dtic.mil/ndia/2009/insensitive/9BZebregs.pdf (last accessed May 10, 2017).

*Primary Examiner* — James E McDonough
(74) *Attorney, Agent, or Firm* — Lisa A. Wang

(57) ABSTRACT

The present invention is directed to propellant grains having multiple layers consisting of an outer, slow burning, layer composition and an inner, fast burning, layer with desirable progressivity burn rates. The outer, slow burning, layer comprising a first energetic material, a first plasticizer and a first binder and an inner, fast burning, layer comprising a second energetic material, and the same plasticizer as the outer layer, and a second binder. The compositions in the propellant grain provided herein provides for a burn rate energy differential between the outer, slow burning, layer and inner, fast burning, layer of at least 2.

15 Claims, 3 Drawing Sheets

(56) References Cited

U.S. PATENT DOCUMENTS

| | | | | |
|---|---|---|---|---|
| 6,209,460 | B1 | 4/2001 | Isle | |
| 7,063,810 | B1 | 6/2006 | Murphy | |
| 2005/0092166 | A1 | 5/2005 | Worrell | |
| 2013/0048163 | A1* | 2/2013 | Hafner | C06B 25/24 149/6 |
| 2015/0284301 | A1 | 10/2015 | Durand | |

* cited by examiner

MULTI-LAYERED STABLE PROPELLANT COMPOSITION

RIGHTS OF THE GOVERNMENT

The inventions described herein may be manufactured and used by or for the United States Government for government purposes without payment of any royalties.

FIELD OF INVENTION

This invention relates generally to the field of propellant compositions and more specifically to multi-layered propellant compositions with one layer having a slow burn rate and an inner layer having a fast burn rate. Each of the layers have a distinctive energetic component but nearly the same binder and plasticizer components to reduce migration of such components during storage and aging.

RELATED APPLICATIONS

This application claims the benefit of U.S. provisional application No. 62/337,543 filed May 17, 2016, the contents of which are incorporated herein by reference in its entirety.

BACKGROUND OF THE INVENTION

When a projectile is fired from a gun barrel, the gases generated by the ignition of the propellant impart a large force which accelerates the projectile down the barrel. As the projectile travels down the barrel, the expansion effect from the burning propellant will increase until a maximum pressure is reached and afterwards, the pressure drops rapidly. To optimize the projectile's performance, its acceleration down the gun barrel should be maximized in the gun barrel for as long as possible without exceeding the mechanical stress limits of the gun. This may be achieved by designing a propellant with a progressive gas generation rate or "progressivity" which optimizes the work imparted on the projectile by the propellant gases as it travels down the gun tube in order to maximize its acceleration characteristics. An ideal progressivity is sought that can accelerate a projectile down the gun tube while reducing the risk of gun tube failure from over-pressurization.

One way to achieve the ideal progressivity is by using two chemically different propellant formulations possessing two markedly different gas generation rates and energy densities. In this design, only the slower burning propellant layer is exposed to the ignition source initially, and the faster burning layer is exposed to the ignition source only after all of the slower layer has been consumed. If the exposure of faster burning layer is properly timed and the gas generation rate differential is large enough, then the gun pressure will reach its peak, subside, rise to a peak again and then subside as the projectile travels down the gun tube. This phenomenon will be depicted as a "double hump" in the pressure-time (P-t) curve, which is characterized by two local peaks and wider shaped curves near the peak pressure when compared to the traditional propellant. The area under the P-t curve is correlated to the pressure-volume (P-V) work of the expanding gas done on the projectile, hence the propulsion system with a wider P-t curve that remains below the permissible pressure limit of the gun tube will result in a higher kinetic energy projectile.

There are multiple ways to manufacture multi-layered propellant compositions having different gas generation rates. One way is to fabricate thin layers of energetic thermoplastic elastomer (ETPE) based propellants and laminate the layers using heat and pressure. The faster burning layer is sandwiched by two slower burning layers to yield a three-layered slab configuration.

Another method is to feed two streams of thermoplastic-based propellants into an intricately designed die system through which multi-layered slab propellants are extruded. The co-extrusion die must be designed with many features that enable it to control heat, dimensions of individual extrudate layers, and pressure drop between inlet and outlet of the die. The extruded propellants can be post-processed further to be rolled into a scroll configuration or trimmed to pre-designed shapes based on the shape and volume of the targeted propulsion system. The two individual streams can be forced into the co-extrusion die using twin screw extruders, more traditional ram extruders, or a combination of both types.

Durand et al, describes in U.S. Patent Publication No. 20150284301, methods to prepare multi-layered propellant grains by simultaneously extruding one higher viscosity propellant formulation in the shape of a hollow cylinder and a second propellant having low viscosity that is injected into the interior of the first propellant formulation layer. The resulting propellant grain thus having different burn rates. Durand utilizes traditional nitrocellulose formulations that can be co-extruded to increase ballistic efficiency if the burn rate differential is large enough for a given gun system. These nitrocellulose formulations, however, have a tendency for the ingredients (e.g. plasticizer) in the formulation to migrate across the outer propellant layer and inner propellant layer until an equilibrium is reached, thus losing the ballistic benefits of a burn rate differential. This migration effect is also exacerbated at elevated temperatures or after aging.

The present disclosure addresses the migration of the propellant ingredients within the co-extruded propellant matrix.

SUMMARY OF THE INVENTION

It is an object of the invention to provide for propellant grain compositions comprising multiple layers with the outer, slow burning, layer comprising a first energetic material, wherein the energetic material is nitroguanidine (NQ) or 1,1-diamino2,2-dinitroethene (DADNE), a first binder, and a first plasticizer, and an inner, fast burning, layer comprising a second energetic material different from the first energetic material, a second binder, and a second plasticizer, wherein the binders used in the outer and inner composition are cellulosic binders, and wherein the plasticizers used in the outer and inner composition are the same, and wherein the binder-to-plasticizer ratios in both the outer and inner layer compositions are about the same.

In one aspect of the invention, the first energetic material is NQ and the second energetic material is HMX.

In another aspect of the invention, the second energetic material is selected from the group consisting of 2,4,6,8,10,12-hexa-nitro-2,4,6,8,10,12-hexaazatetracyclo-dodecane (CL-20), octohydro-1,3,5,7-tetranitro-1,3,5,7-tetrazocine (HMX), 1,3,5-trinitroperhydro-1,3,5-triazine (RDX), and guanylurea dinitramide (GUDN).

In another aspect of the invention, the first binder is nitrocellulose (NC) and the second binder is plastisol nitrocellose (PNC).

In another aspect of the invention, the cellulosic binder has greater than 11% in nitration.

In another aspect of the invention, the plasticizer is DEGDN, BTTN, TEGDN, NENA, NG or triacetin or a combination thereof.

In another aspect of the invention, the multi-layer propellant grain is prepared in concentric layers or stacked layers.

In another aspect of the invention, the multi-layer propellant grain is prepared by a process where at least one layer is laminated.

BRIEF DESCRIPTION OF THE DRAWINGS

Further features and advantages of the present invention may be understood from the following drawings.

DETAILED DESCRIPTION

Provided herein is a multi-layered propellant grain or stick having an outer, slow burning, layer and an inner, fast burning, layer. The multi-layered propellant composition disclosed herein overcomes the problems associated with traditional multi-layered compositions by preventing migration of components between the layers as the propellant ages while retaining the desirable characteristics and burn rate requirements (progressivity characteristics) of a multi-layered propellant composition.

Figure 1A:
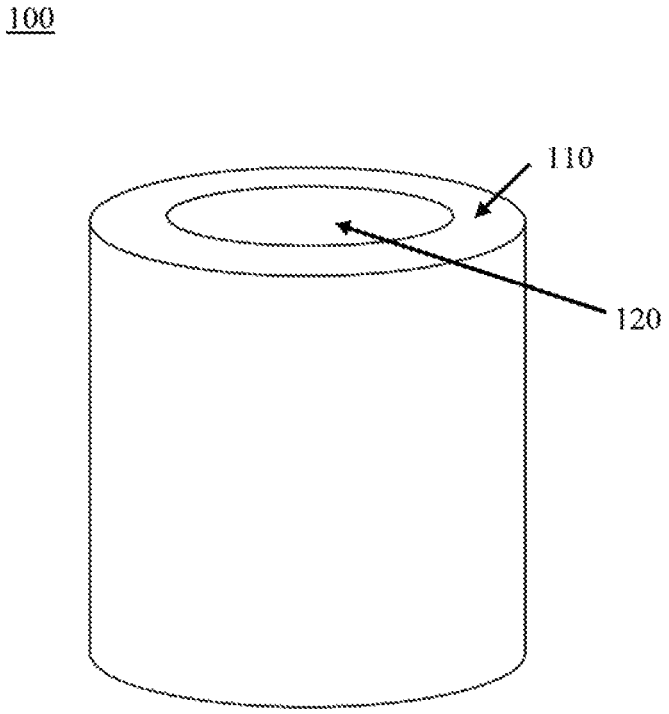
FIG. 1A is an illustration of a representative co-extruded propellant grain having an outer, slow burning, layer and an inner, fast burning, layer.
Figure 1B:
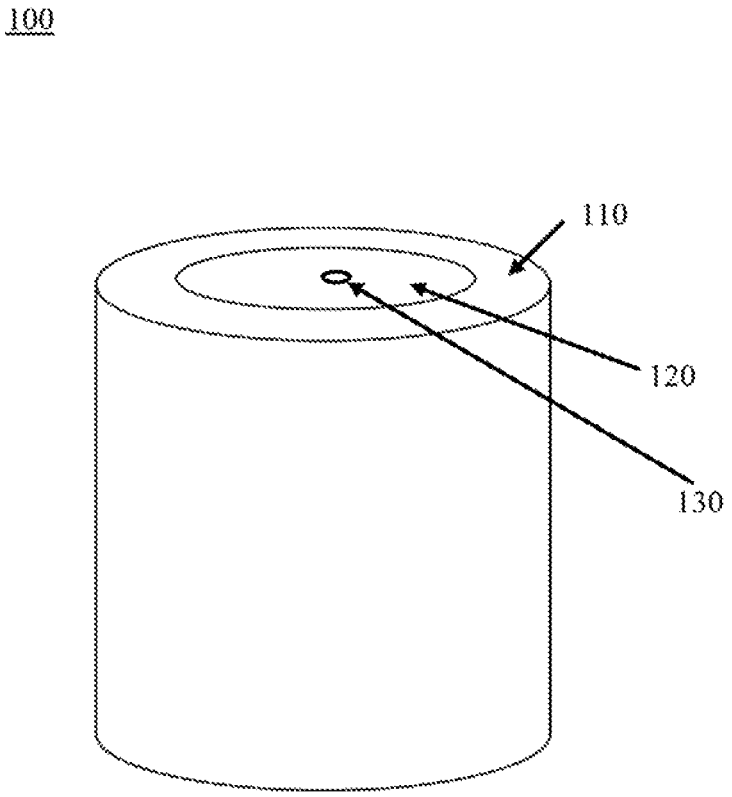
FIG. 1B is an illustration of a different embodiment for FIG. 1A having a central perforation running through the longitudinal axis of the propellant grain.

FIG. 1A illustrates one embodiment of a multi-layered propellant grain 100 composed of an outer, slow burning, layer 110 that may be shaped as a hollow cylinder and an inner, fast burning, layer 120 situated within the hollow cylinder such that the outer, slow burning, layer completely surrounds the inner, fast burning, layer. The inner cylinder may be single- or multi-perforated 130 to achieve higher progressivity depending on the processing limitation and gun application as illustrated in FIG. 1B.

The composition of the outer, slow burning, layer is comprised of a binder in the range of 20-99 wt % and preferably 25-40 wt %, an energetic fill or a combination of energetic fills including, but not limited to, nitroguanidine (NQ) and 1,1-diamino 2,2-dinitro ethylene (DADNE) in the range of 5-70 wt %, and preferably 20-60 wt %, and a plasticizer or a combination of plasticizers including, but not limited to, nitroglycerin (NG), diethyleneglycol dinitrate (DEGDN), trimethylolethane trinitrate (TMETN), nitratoethyl nitramine (NENA) and triacetin in the range of 5-40 wt %, and preferably in the range of 10-35 wt %.

The composition of the inner, fast burning, layer is comprised of a binder of 25-70 wt %, and preferably 40-60 wt %, an energetic solid fill including but not limited to, CL-20, HMX, RDX, and GUDN in the range of 5-70 wt %, and preferably 20-60 wt %, and a plasticizer or a combination of plasticizers including, but not limited to, nitroglycerin (NG), diethyleneglycol dinitrate (DEGDN), trimethylolethane trinitrate (TMETN), nitratoethyl nitramine (NENA) and triacetin in the range of 5-40 wt %, and preferably 15-25 wt %. While the energetic material may be different between the outer layer and inner layers, binder and plasticizer components for both layers must be essentially the same with nearly equal ratios of these two components between the two layers.

The binder may consist of a cellulosic binder, or combinations of cellulosic binders, such as polymeric nitrocellulose (NC), plastisol nitrocellulose (PNC), cellulose acetate butyrate (CAB), cellulose acetate (CA), and cellulose acetate nitrate (CAN), that function to bind the composition in each layer. It is preferred that such NC and CAN binders be at 11% or greater in nitration.

A number of plasticizers, or combinations of plasticizers, can be used as long as the binder type, plasticizer type, and the binder-to-plasticizer ratio are the same for both the outer layer and inner layer compositions. A typical binder-to-plasticizer ratio ranges from about 2:3 to about 2:1, preferably from about 1:1 to about 3:2. Exemplary plasticizers include nitroglycerine (NG), 1,2,4-butanetriol trinitrate (BTTN), diethylene glycol dinitrate (DEGDN), triacetin, triethylene glycol dinitrate (TEGDN), and nitratoethyl nitramine (NENA). The absolute weight percent of the plasticizer does not necessarily have to be the same for both the outer layer and the inner layer, but the binder-to-plasticizer ratio must be the same in both layers. For instance, two propellant layers having differing plasticizer compositions (in wt %) but a same binder-to-plasticizer ratio can exist, if the compositions of other constituents such as energetic solids, stabilizer, burning rate modifier, or flash suppressants are different in each layer. To illustrate, a multi-layered propellant in which the outer, slow burning, layer consists of 59 wt % of NQ (energetic solid fill), 1 wt % Akardit II (stabilizer), 20 wt % NC (polymeric binder), 20 wt % DEGDN (plasticizer) and the inner, fast burning, layer consists of 49 wt % HMX (energetic solid fill), 1 wt % Akardit II (stabilizer), 25 wt % PNC (polymeric binder), 25 wt % DEGDN (plasticizer), the absolute plasticizer compositions in the outer and inner layers differ at 20 wt % and 25 wt %, respectively. But the binder-to-plasticizer ratio in each of outer and inner layers is the same at a 1:1 ratio. Formulating two layers with differing solid fill composition may be necessary in order to improve the sensitivity, processibility, and/or performance of the composite propellant grain.

Other additives such as stabilizers, flash suppressants, and burning rate modifiers, may be added to each layer. A stabilizer, or combination of stabilizers, including but not limited to, Akardit II, ethyl centralite (EC), and 2-nitrodiphenylamine (2NDPA) is added to each layer containing any amount of nitrate ester to stabilize the propellant by scavenging $NO_x$ (NO and $NO_2$) species that are produced during the service life of the propellant. A flash suppressant, or combination of flash suppressants, including but not limited to, potassium nitrate, potassium sulfate, and barium nitrate can be added to suppress muzzle flash during gun firing. A burning rate modifier, or combination of burn rate modifiers, including but not limited to, bismuth subsalicylate modify the burning rate at a certain pressure range. All of the additives are incorporated anywhere from a fraction of a percent up to 4 wt % with minimum stabilizer content being 1 wt %.

It is desirable that the resulting fast-slow burning propellant pair has the burning rate differential of about 2 or higher near the peak pressure to be effective in improving the ballistic efficiency. The higher the differential, the more the efficiency is improved.

There are several methods for manufacturing the multi-layered propellant grains having the compositions described herein. One method utilizes a co-extrusion process to form two concentric layers having an outer, slow burning, layer and an inner, fast burning, layer of the propellant granule as disclosed by Durand et al in U.S. Patent Publication No. 20150284301. The co-extrusion process in Durand for producing concentric layers is hereby incorporated in its entirety.

Other methods may also be utilized that is well known to those in propellant processing arts. For instance, co-layered fast and slow burning layers may be stacked and spirally wrapped as described in Blasche et al., U.S. Pat. No. 4,013,743. Additionally, the propellant grain layers may be laminated. For the laminate process, each of the layers are laminated using heat and pressure and stacked in a rectangular slab configuration such that the fast-burning layer is situated in the middle between the top and bottom slow-burning layers. An exemplary illustration for this process is found in U.S. Pat. No. 4,581,998 to Horst which is incorporated herein by reference.

EXAMPLES

Specific combinations of energetics, binders, and plasticizers achieving a burning rate differential of about 2 are listed, along with their predicted impetus and flame temperature, in Table 1 below. Typically, the higher the predicted impetus, or energy density, the higher the burning rate of a given propellant. The burning rate of a propellant cannot be calculated but can only be derived empirically. However, the energy density can be calculated using a thermochemical code such as Cheetah 6.0 (available from Lawrence Livermore Laboratory). For the slow and fast burning propellant pairing found in Example 1, the binder and plasticizer consist of 25 wt % NC (12.6% N) and 13 wt % BTTN. The energetic solids fills in slow and fast formulation are 60 wt % NQ and 60 wt % HMX, respectively. The calculated energy density difference was 286 J/g and the burning rate differential of this pairing was found to be 2.80 at the pressure of 430 MPa. In Example 2, the energetic solid fills were varied from Example 1 while keeping the rest of the composition ingredient ratios constant. The fills for slow and fast formulations were 60 wt % DADNE and 60 wt % CL-20, respectively. The calculated energy density difference was found to be slightly greater than that of Example 1 at 293 J/g. It is expected that this pairing would result in better, or as good, burning rate differential. Similarly, in Example 3, only the plasticizer type was varied from BTTN to DEGEN while keeping other variables constant. The energy density difference was found to be 294 J/g, which is greater than that of Example 1. Knowing that Example 1 has a burning rate differential of 2.80 at peak pressure, and assuming that the burning rate differential is closely tied to the energy density difference within a family of propellants comprised of common ingredients, Examples 2 and 3 show that there are many possible pairings of slow-fast formulations for the co-extruded propellant application.

TABLE 1

High and Low Energy Propellant Pairings for Co-extraded Propellant Application

| | Example 1 | | Example 2 | | Example 3 | |
|---|---|---|---|---|---|---|
| | Slow | Fast | Slow | Fast | Slow | Fast |
| NQ (wt%) | 60 | — | — | — | 60 | — |
| HMX (wt %) | — | 60 | — | — | — | 60 |
| BTTN (wt %) | 13 | 13 | 13 | 13 | — | — |
| DADNE (wt %) | — | — | 60 | — | — | — |
| CL-20 (wt %) | — | — | — | 60 | — | — |
| DEGDN (wt %) | — | — | — | — | 13 | 13 |
| Impetus (J/g) | 991 | 1277 | 997 | 1290 | 965 | 1259 |
| Flame Temp (K) | 2661 | 3715 | 2800 | 4066 | 2479 | 3558 |
| ΔImpetus (J/g) | 286 | | 293 | | 294 | |
| ΔFlame Temp (K) | 1064 | | 1266 | | 1079 | |

A total of 9 pairs of inner fast burning layer composition and slow outer layer compositions were formulated with the ingredients and amounts in accordance with Table 2. HMX was used as an energetic in the inner, fast burning, layer composition and NQ was used as an energetic in the slow burning outer layer formulations. The amount of energetic solid fill in the compositions was 60 wt % for each respective layer. Nitrocellulose (12.6% N) and BTTN were used as the polymeric binder and plasticizer, respectively, for both layers. The amount of NC in the compositions was 25 wt % for both layers while BTTN made up 13 wt % of both slow and fast burning layers, respectively. In this example, the difference in energy density, flame temperature, and burning rate differential between HMX and NQ was calculated to be 286 J/g, 1064 K, and 2.80 at 430 MPa, respectively.

The compositions, impetus, and flame temperature values for each of 9 formulation pairs are presented in Table 2.

TABLE 2

Compositions and Themochemical Data of Thermally Stable Propellants

| Propellant ID | NC* (wt %) | HMX (wt %) | NQ (wt %) | Triacetin (wt %) | BTTN (wt %) | Minor Constituents (wt %) | Impetus (J/g) | Flame Temp (K) |
|---|---|---|---|---|---|---|---|---|
| Slow-2 | 25 | — | 60 | 6 | 7 | 2 | 884 | 1170 |
| Fast-2 | 25 | 60 | — | 6 | 7 | 2 | 1194 | 3316 |
| Slow-3 | 30 | — | 50 | 9 | 9 | 2 | 854 | 2190 |
| Fast-3 | 30 | 50 | — | 9 | 9 | 2 | 1120 | 3059 |
| Slow-4 | 21 | — | 66 | 5 | 6 | 2 | 888 | 2274 |
| Fast-4 | 21 | 66 | — | 6 | 6 | 2 | 1215 | 3379 |
| Slow-5 | 25 | — | 60 | — | 13 | 2 | 991 | 2661 |
| Fast-5 | 25 | 60 | — | — | 13 | 2 | 1277 | 3725 |
| Slow-6 | 21 | — | 66 | — | 11 | 2 | 977 | 2594 |
| Fast-6 | 21 | 66 | — | — | 11 | 2 | 1295 | 3774 |
| Slow-7 | 22 | 15 | 50 | 11 | — | 2 | 840 | 1157 |
| Fast-7 | 22 | 66 | — | 11 | — | 1 | 1134 | 3061 |

TABLE 2-continued

Compositions and Themochemical Data of Thermally Stable Propellants

| Propellant ID | NC* (wt %) | HMX (wt %) | NQ (wt %) | Triacetin (wt %) | BTTN (wt %) | Minor Constituents (wt %) | Impetus (J/g) | Flame Temp (K) |
|---|---|---|---|---|---|---|---|---|
| Slow-8 | 27 | — | 56 | 8 | 8 | 1 | 872 | 7735 |
| Fast-8 | 27 | 56 | — | 8 | 8 | 1 | 1166 | 3240 |
| Slow-9 | 24 | — | 60 | 6 | 9 | 1 | 908 | 1333 |
| Fast-9 | 24 | 60 | — | 6 | 9 | 1 | 1210 | 3413 |
| Slow-10 | 28 | — | 53 | 5 | 12 | 2 | 941 | 2468 |
| Fast-10 | 28 | 53 | — | 5 | 12 | 2 | 1163 | 3219 |

If a paste-like low viscosity material is required for processing, PNC can be used in place of traditional wood pulp NC or cotton linter NC.

The Slow-5 and Fast-5 propellant pair from Table 2 was chosen for further characterization to determine their burning rates and thermal stability. Results of that characterization are shown in Table 3.

TABLE 3

Linear Burning Rates (BR) and BR Ratio of Slow-5 and Fast-5 Propellant Pair

| P (MPa) | Fast-1 Linear BR (cm/s) | Slow-1 Linear BR (cm/s) | Burning Rate Ratio |
|---|---|---|---|
| 100 | 11.46 | 7.08 | 1.62 |
| 130 | 15.17 | 8.49 | 1.79 |
| 160 | 18.94 | 9.81 | 1.93 |
| 190 | 22.76 | 11.05 | 2.06 |
| 220 | 26.62 | 12.23 | 2.18 |
| 250 | 30.52 | 13.37 | 2.28 |
| 280 | 34.45 | 14.47 | 2.38 |
| 310 | 38.41 | 15.53 | 2.47 |
| 340 | 42.39 | 16.55 | 2.56 |
| 370 | 46.40 | 17.56 | 2.64 |
| 400 | 50.44 | 18.53 | 2.72 |
| 430 | 54.49 | 19.49 | 2.80 |

The burning rates of the two propellant formulations at 430 MPa, the maximum allowable mean gun pressure for the GAU-8 30 mm cannon, are 19.5 cm/s and 54.5 cm/s for slow and fast propellants, respectively. The ratio of the burning rates at this pressure was calculated to be 2.80. For the verification of composition stability, accelerated aging testing was conducted. The propellants were individually extruded, rolled, and sandwiched to produce two-layered test coupons.

Figure 2:
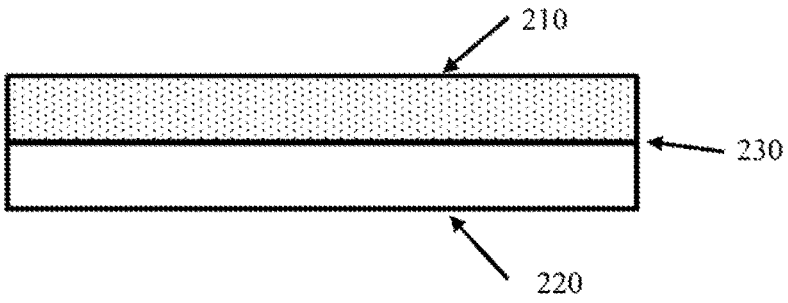
FIG. 2 is an exemplary two-layer test coupon that is comprised of an outer, slow burning layer and an inner, fast burning, layer.

The cross-section of the two-layered coupons could be seen in FIG. 2 having a slow burning layer 210 and a fast burning layer 220 with a fast-slow interface 230. Individual layers can be made separately, overlaid, and pressed together ensuring an intimate contact between the layers. Smaller pieces of these test coupons were thermally conditioned for the accelerated aging test. The samples were aged at elevated temperatures of 60, 70, and 80° C. for the durations of 4, 7, 10, 14, 21, and 28 days. The BTTN concentrations of the aged coupons were analyzed using high pressure liquid chromatography (HPLC) and the normalized values were compared between the slow and fast burning layers to detect any change from the initial condition. With an exception at the conditions of 70° C. and 28 days, the percentage difference across the slow-fast interface is less than +/−10%. The % Difference value obtained at the conditions of 70° C. and 28 days was calculated to be an outlier and disregarded, since the value is farther than 1.5 times the interquartile range (IQR) from the upper quartile. Considering possible errors in processing, sample preparation, measurement, and the fact that there is only 13 wt % of BTTN present in these propellant formulations, the percent difference of 10 and below should have negligible effect on the overall performance of the propellants. The normalized and relative BTTN concentration and percent difference values can be found in Table 4.

TABLE 4

Relative BTTN Concentrations in Layers after Aging

| Aging conditions | | Relative Concentration BTTN[1] | | % |
|---|---|---|---|---|
| Duration | T (°C.) | Layer 1 | Layer 2 | Difference |
| BASELINE | 20 | 91 | 96 | −5.5 |
| 14-DAY | 60 | 100 | 90 | 10.0 |
| 28-DAY | 60 | 95 | 92 | 3.2 |
| 7-DAY | 70 | 89 | 91 | −2.2 |
| 14-DAY | 70 | 85 | 85 | 0.0 |
| 21-DAY | 70 | 90 | 92 | −2.2 |
| 28-DAY | 70 | 83 | 68 | 18.1 |
| 4-DAY | 80 | 88 | 92 | −4.5 |
| 7-DAY | 80 | 91 | 85 | 6.6 |
| 10-DAY | 80 | 89 | 88 | 1.1 |
| 14-DAY | 80 | 86 | 92 | −7.0 |

Notes:

1. Analysis of BTTN conducted by high pressure liquid chromatography.
2. Relative weight concentration determined as BTTN peak area (integrated at 234.0 nm) divided by sample weight and normalized (divided by the maximum of all samples).

The foregoing description of the preferred embodiments of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description but by the claims and any equivalents.

What is claimed is:

1. A multi-layered propellant grain comprising:

(a) an outer, slow burning, layer composition comprising a first energetic material, wherein the first energetic material is nitroguanidine (NQ) or 1,1-diamino2,2-dinitroethene (DADNE), a first binder wherein the first binder is a cellulosic binder selected from the group of consisting of cellulose acetate butyrate (CAB), cellulose acetate (CA), or cellulose acetate nitrate (CAN), and a first plasticizer; and (b) an inner, fast burning, layer composition comprising a second energetic, wherein said second energetic material is different from the first energetic material, a second binder wherein the second binder is plastisol nitrocellulose (PNC), and a second plasticizer; and (c) wherein the first and second plasticizers are the same.

2. The multi-layered propellant grain of claim 1, wherein the second energetic material is selected from the group consisting of 2,4,6,8,10,12-hexa-nitro-2,4,6,8,10,12-hexaazatetracyclo-dodecane (CL-20), octohydro-1,3,5,7-tetranitro-1,3,5,7-tetrazocine (HMX), 1,3,5-trinitroperhydro-1,3,5-triazine (RDX), guanylurea dinitramide (GUDN).

3. The multi-layered propellant grain of claim 1, wherein the first energetic material is NQ and the second energetic material is HMX.

4. The multi-layered propellant grain of claim 1, wherein the first binder is at least one cellulosic binder selected from the group consisting of polymeric nitrocellulose (NC), cellulose acetate butyrate (CAB), cellulose acetate (CA), and cellulose acetate nitrate (CAN).

5. The multi-layered propellant grain of claim 1, wherein the binder for both layers is polymeric nitrocellulose at 11% or greater in nitration.

6. The multi-layered propellant grain of claim 1, wherein the plasticizer is selected from the group consisting of nitroglycerine, 1,2,4-butanetriol trinitrate (BTTN), diethylene glycol dinitrate (DEGDN), triacetin, triethylene glycol dinitrate (TEGDN), and nitratoethyl nitramine (NENA).

7. A The multi-layered propellant grain composition of claim 1:

(a) wherein the first energetic material is about 5-70 wt %, the first binder is about 25-40% wt %, and the first plasticizer is about 5-40 wt %; and (b) and wherein the second energetic material different from the first energetic material is about at 5-70 wt %, the second binder about 25-70 wt %, and the second plasticizer is about 5-40 wt %.

8. The multi-layered propellant grain of claim 7, wherein the first energetic material is NQ and the second energetic material is HMX.

9. The multi-layered propellant grain of claim 7, wherein the outer slow burning layer composition or the inner fast burning layer composition further comprises at least one additive selected from the group consisting of a stabilizer, a flash suppressant, and burning rate modifier.

10. The multi-layered propellant grain of claim 4, wherein the total weight percentages of the additives are up to 4%.

11. The multi-layered propellant grain of claim 7, wherein the first binder is NC.

12. The propellant composition of claim 7, wherein the outer slow burning layer and inner slow burning layer are in direct contact with each other.

13. The propellant composition of claim 1, wherein the first energetic material is DADNE.

14. The propellant composition of claim 1, wherein the ratio of the first binder to the first plasticizer is about 1:1 to about 3:2 and the ratio of the second binder to the second plasticizer is the same.

15. The propellant composition of claim 1, wherein the first and second plasticizer is 1,2,4-butanetriol trinitrate (BTTN).

* * * * *